United States Patent [19]

Jackman et al.

[11] Patent Number: 4,591,676

[45] Date of Patent: May 27, 1986

[54] INERTIA SWITCH IMPACT SENSOR

[75] Inventors: Peter R. Jackman; Paul P. Stratton, both of Hampshire, England

[73] Assignee: First Inertia Switch Limited, Hampshire, England

[21] Appl. No.: 668,269

[22] PCT Filed: Mar. 8, 1984

[86] PCT No.: PCT/GB84/00074

§ 371 Date: Nov. 2, 1984

§ 102(e) Date: Nov. 2, 1984

[87] PCT Pub. No.: WO84/03585

PCT Pub. Date: Sep. 13, 1984

[30] Foreign Application Priority Data

Mar. 10, 1983 [GB] United Kingdom ..... 8306581

[51] Int. Cl.[4] ..... H01H 35/14

[52] U.S. Cl. ..... 200/61.45 M; 200/DIG. 29

[58] Field of Search ..... 200/61.45 R, 61.45 M, 200/DIG. 29, 61.46, 61.47, 61.48, 61.49, 61.50, 61.51, 61.52

[56] References Cited

U.S. PATENT DOCUMENTS

| | | | |
|---|---|---|---|
| 2,794,084 | 5/1957 | Segoni | 200/61.52 |
| 3,270,159 | 8/1966 | Soos | 200/61.45 M |

FOREIGN PATENT DOCUMENTS

| | | |
|---|---|---|
| 2261974 | 6/1974 | Fed. Rep. of Germany . |
| 2064509 | 7/1971 | France . |
| 2088449 | 1/1972 | France . |
| WO79/00500 | 8/1979 | PCT Int'l Appl. . |
| 1368492 | 9/1974 | United Kingdom . |

*Primary Examiner*—A. D. Pellinen
*Assistant Examiner*—Morris Ginsburg
*Attorney, Agent, or Firm*—Shapiro and Shapiro

[57] ABSTRACT

A ferromagnetic ball is mounted between dished first and second contacts and subjected to magnetic restraint tending to retain the ball in its central, rest position by means of a rare earth type magnet which is accurately positioned relative to the ball by a polyester shim clamped between the first contact and the magnet as a result of resilient deformation of an annular portion of a cap attached to a housing member enclosing the first and second contacts. Lugs extending from the first and second contacts pass through openings in the housing member and through apertures in a printed circuit board to which the sensor is attached by dowels. The lugs are then attached to the printed circuit board by soldering.

6 Claims, 3 Drawing Figures

INERTIA SWITCH IMPACT SENSOR

FIELD OF THE INVENTION

The invention relates to an inertia switch impact sensor, for vehicle crash detection, for the interruption or initiation of electrical currents such as those controlling fuel flow and central door locking units.

BACKGROUND ART

Vehicle manufacturers are increasingly employing electronic control units which operate in response to signals from inertia switch impact sensors. Electronic controls are already common both in door locking and fuel management systems. This move to electronic processing of sensor signals and the use of driver stages or relays to perform power switching has prompted the development of smaller and smaller low power switches and transducers which are frequently required to be small enough to be directly mountable within electronic control modules.

Known inertia switch impact sensors for this purpose comprise a ferromagnetic ball; a dished first contact having a circular portion of smaller diameter than the ball, for supporting the ball in a rest position, and an upwardly inclined outer portion extending from the circular portion; a second contact extending around a circle for engagement by the ball, on movement of the ball away from its rest position as a result of impact by the vehicle, to complete an electrical path between the two contacts; and a magnet disposed below the ball and spaced from the first contact.

One way to adjust the strength of the magnet so as to ensure that the sensor operates correctly is to fit the magnet in a fully magnetized condition and then to demagnetize the magnet until the restraint it exerts on the ball is reduced to the required level.

In mass production, when magnets are not demagnetized, to avoid this additional process step, in different production runs where magnets of the same strength are required to hold the balls with different retaining forces, trouble is encountered unless each magnet is positioned precisely in relation to the first contact. Also, as a result of the manner in which magnetic field strength varies with distance, it has been found necessary to space the magnet a relatively large distance from the first contact since, if the magnet is too close to the first contact, small deviations from the correct position of the magnet cause large variations in the force exerted by the magnet on the ball. This is important because the position of the magnet depends on dimensional imperfections in at least two parts: the member supporting the magnet and the magnet itself. Thus, in practice, it is normal to leave a relatively large air gap between the magnet and the first contact so that any imprecision in the positioning of the magnet will result in only minor variation in the force exerted by the magnet on the ball.

DISCLOSURE OF THE INVENTION

It is the object of the present invention to overcome the deficiencies of known inertia switch impact sensors so as to provide smaller sensors for use with electronic control apparatus, and to provide a form of construction in which the retaining force exerted by the magnet in different runs of mass produced sensors can be simply and accurately changed.

This is achieved by providing the sensor with a non-magnetic shim which is disposed between the first contact and the magnet; and a support for the magnet to cause the magnet to press the shim against the first contact to thereby precisely position the magnet relative to the first contact.

Thus, according to the invention there is provided an inertia switch impact sensor, for vehicle crash detection, comprising a ferromagnetic ball; a dished first contact having a circular portion of smaller diameter than the ball, for supporting the ball in a rest position, and an upwardly inclined outer portion extending from the circular portion; a second contact extending around a circle for engagement by the ball, on movement of the ball away from its rest position as a result of impact by the vehicle, to complete an electrical path between the two contacts; a magnet disposed below the ball and spaced from the first contact; a non-magnetic shim disposed between the first contact and the magnet; and a support for the magnet to cause the magnet to press the shim against the first contact.

The support preferably has a resiliently deformable portion which, when the sensor is assembled, is deformed so as to effect the necessary pressure.

Where it is desired to form sensors having different ball retaining forces using the same magnets in different mass production runs, the shims disposed between the magnets and the first contacts of the sensors of each run are of different thickness. Where the support has a resiliently deformable portion, this different thickness is accommodated within the resilient deformation of the resiliently deformable portion.

In a preferred embodiment of the invention, the magnet is a rare earth type magnet. These magnets are smaller than other permanent magnets and so this permits even further reduction in the size of the sensor. Moreover, it is understood that demagnetization of rare earth type magnets is more difficult than with other types of permanent magnet, so the use of spacer shims is particularly useful when rare earth type magnets are used.

Three embodiments of the invention are hereinafter described, by way of example, with reference to the accompanying drawings.

MODES FOR CARRYING OUT THE INVENTION

Figure 1:
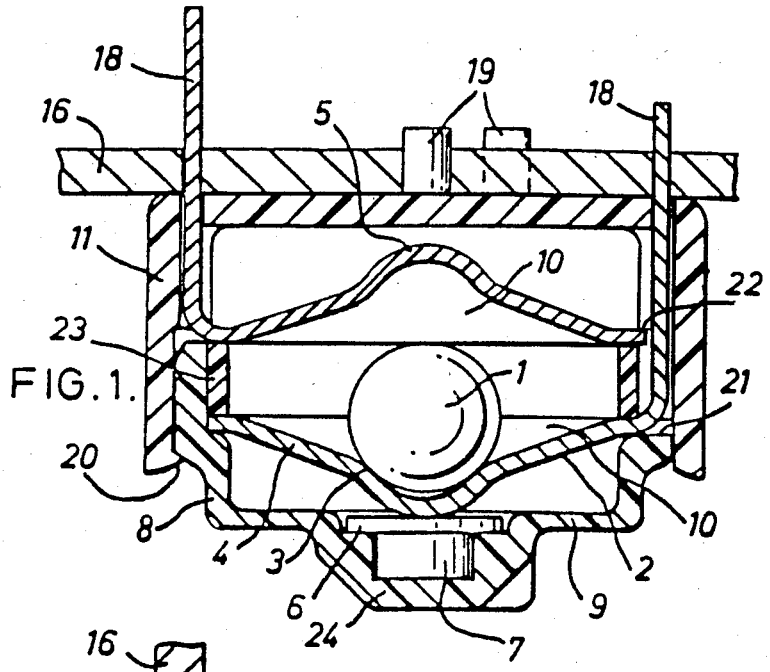
FIG. 1 is a sectional side elevation of an inertia switch impact sensor, according to the present invention, attached to a horizontal printed circuit board.

As shown in FIG. 1, a 5 mm steel ball 1 is supported in a dished first contact 2 formed by pressing a substantially circular piece of brass sheet with a radially extending portion 18 which is bent upwardly to form a connecting lug. A second contact 5 is formed by a similar pressing operation on an identical piece of brass plate so that the first and second contacts 2 and 5 have identical concave portions 10. However, the radially extending portion 18 of the second contact 5 is bent in the opposite direction so that when the two concave portions 10 are arranged to face each other, both contact lugs project upwardly for connection to a printed circuit board 16.

The first and second contacts 2 and 5 are enclosed in a plastic cup-shaped part 11 having two dowels 19 for connecting the sensor to the printed circuit board 16. The cup-shaped member 11 has a plastic cap 8 which is held within the cup-shaped member 11 by resilient engagement with a lip 20 on at least part of the rim of the cup-shaped member 11. The cap 8 and cup-shaped member 11 are respectively formed with internal shoulders 21 and 22 which locate the peripheral edges of the first and second contacts 2 and 5 and a sleeve 23 disposed between the first and second contacts 2 and 5 maintains the first and second contact 2 and 5 in correct spaced relation.

The first contact 2 has a central part-spherical portion of smaller diameter than the ball 1 and so the ball 1 rests on the circular portion 3 between this part-spherical portion and an upwardly inclined outer portion 4. This prevents the ball 1 from rolling freely in the concave portion 10 of the first contact 2 when the sensor subject to horizontal vibration. The inclination of the outer portion 4 of the first contact 2 (and thus the inclination of the equivalent portion of the second contact 5) is chosen so as to ensure that the ball 1 will neither rebound too rapidly from the second contact 5 nor wedge itself between the first and second contacts 2 and 5.

As shown, cap 8 has a flexible annular portion 9 supporting a hub 24 formed with a recess for accommodating a rare earth type magnet 7 and a polyester shim 6 which is clamped between the part-spherical portion of the first contact 2 and the magnet 7 as a result of resilient deformation of the annular portion 9 of the cap 8. The space between the ball 1 and magnet 7 may be kept small, by using a shim 6 having a thickness of only 0.5 mm, for example, and the accuracy of the space between the first contact 2 and the magnet 7 depends only on the tolerance of the thickness of the shim 6. Therefore, it is possible to assure that the magnetic field strength to which the ball 1 is subjected falls within acceptable limits.

If it is desired to produce sensors in which the ball is subjected to a different magnetic field strength, this can be effected simply by replacing the shim 6 with a shim of different thickness. However, it is of course necessary to ensure that the cap 8 can accommodate the replacement shim 6 and that the annular portion 9 of the cap 8 is resiliently deformed to such an extent that the replacement shim 6 is clamped between the first contact 2 and the magnet 7.

Figure 2:
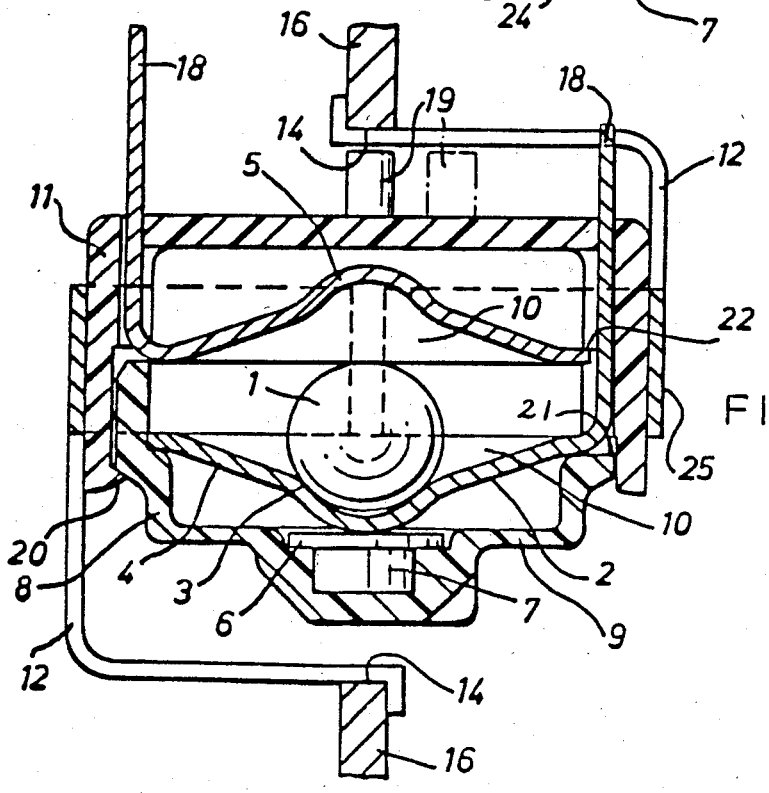
FIGS. 2 and 3 are sectional side elevations of assemblies respectively including sensors, as shown in FIG. 1, and two forms of spring mounting respectively mounted in vertical and inclined printed circuit boards.

FIG. 2 shows an assembly in which a sensor similar to that shown in FIG. 1 is fitted with a clip, shown in dashed outline, having a resilient band 25 surrounding the housing member 11 and two spring arms 12 extending above and below the sensor for engagement with the edge of a circular aperture 14 in a printed circuit board 16. The sensor can thus be rotated about a horizontal axis extending perpendicular to the printed circuit board 16 so as to ensure that its own central axis is perfectly vertical. The spring arms 14 can then be soldered in place on the printed circuit board and soldered connections can also be made between the lugs 18 of the first and second contacts 2 and 5. Quite clearly, it is possible to modify the sensor so that the lugs 18 are shaped differently and project through differently spaced openings in the housing member 11 as desirable to facilitate connection of these lugs 18 to the printed circuit board 16.

Figure 3:
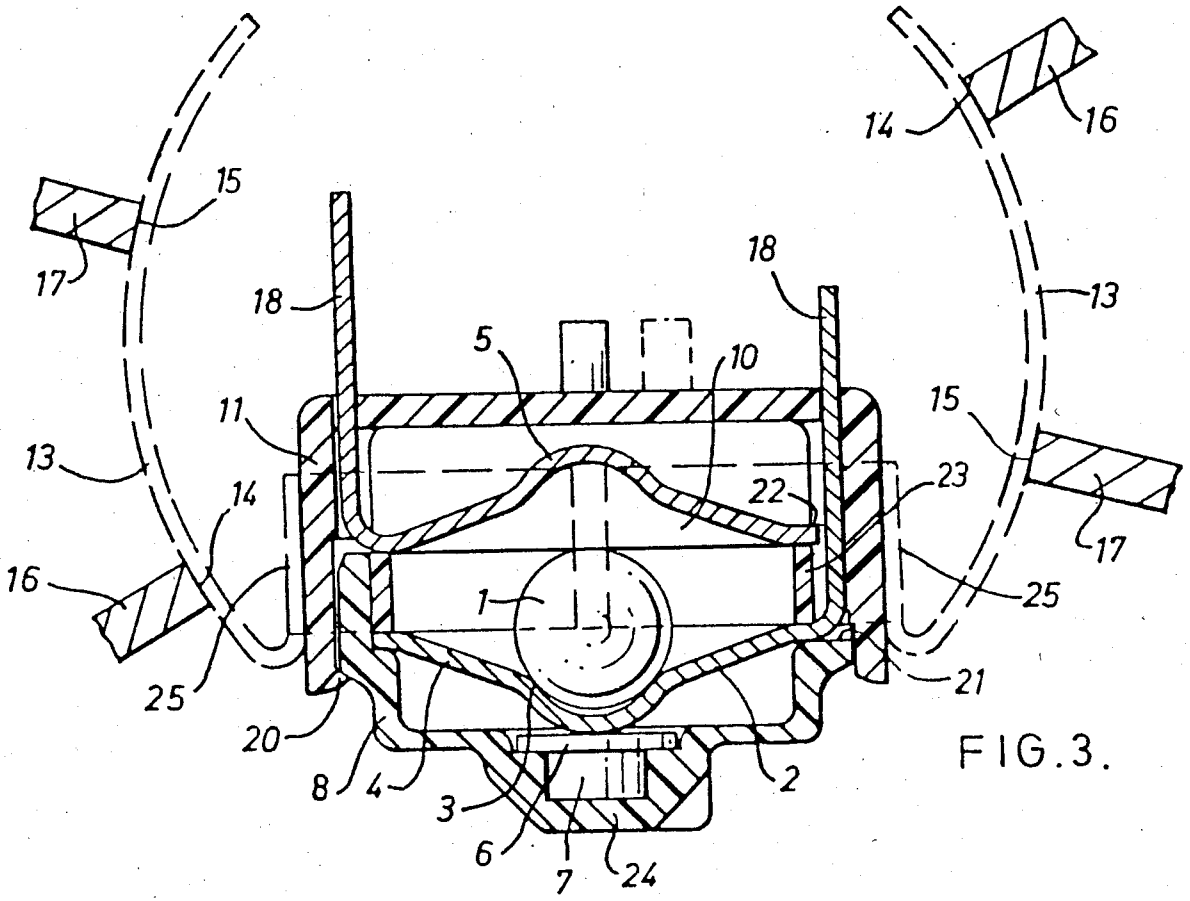

FIG. 3 also shows an assembly of a sensor similar to that shown in FIG. 1 fitted with a clip having a resilient band 25 surrounding the housing member 11. However, in this case, two arcuate spring arms 13 extend from the band 25 on opposite sides of the sensor for engagement with diametrically opposite sides of a circular aperture 14 in a printed circuit board 16 so as to permit rotation of the assembly about a diameter extending between these diametrically opposite edges of the aperture 14 and also about a horizontal axis extending perpendicular to this diameter so as to ensure that the central axis of the sensor is perfectly vertical.

The spring arms 13 are of arcuate form so as to permit the sensor to be mounted in the alternative in a circular aperture 15 formed in a printed circuit board 17 which is oppositely inclined to the printed circuit board 16.

Once again, it is possible to solder the spring arms 13 to the printed circuit boards 16 or 17 and to modify the lugs 18 of the first and second contacts 2 and 5 so as to facilitate their connection to the required printed circuit boards 16 or 17.

It is to be understood that the sleeve 23 may be replaced by arcuate projections formed on the cap 8 and on the cup-shaped member 11, which are cooperable with the edges of first and second contacts 2 and 5, respectively, to support the contacts within the sensor.

We claim:

1. An inertia switch impact sensor, such as for vehicle crash detection, comprising:

a ferromagnetic ball (1);

a dished first contact (2) having a circular portion (3) of smaller diameter than the ball (1), for supporting the ball (1) in a rest position, and an upwardly inclined outer portion (4) extending from the circular portion (3);

a substantially circular second contact (5) for engagement by the ball (1), on movement of the ball (1) away from its rest position, to complete an electrical path between the first and second contacts (2 and 5); and a magnet (7) disposed below the ball (1) and spaced from the first contact (2);

characterized in that:

a non-magnetic shim (6) is disposed between the first contact (2) and the magnet (7); and the magnet (7) is supported by a support (8) having pressing means for causing the magnet (7) to press the shim (6) against the first contact (2) so as to precisely space the magnet (7) relative to the first contact (2).

2. A sensor, according to claim 1, in which said pressing means comprises a resiliently deformable portion (9) of the support (8).

3. A sensor, according to claim 1, in which the magnet (7) is a rare earth type magnet.

4. A sensor, according to claim 1, in which the first and second contacts (2 and 5) have identical concave portions (10), the concave portion of one of said contacts being inverted relative to the concave portion of the other of said contacts so as to face the other of said contacts.

5. A sensor, according to claim 1 in which:

a housing member (11) surrounds the first and second contacts (2 and 5); and two spring arms (12 or 13) extend from opposite sides of the housing member (11) for engagement with internal edge portions of a circular aperture (14 or 15) in a supporting plate (16 or 17) so as to permit rotation of the sensor about a horizontal axis through a centre of the aperture (14 or 15).

6. A sensor, according to claim 5, in which the arms (13) are curved and capable of adopting a radius of curvature the same as that of said circular aperture (14 or 15) when engaged with said internal edge portions of the circular aperture (14 or 15) so that the sensor can also be rotated about an axis extending diametrically across the circular aperture (14 or 15).

* * * * *